US006561160B2

(12) United States Patent
Suzuki et al.

(10) Patent No.: US 6,561,160 B2
(45) Date of Patent: May 13, 2003

(54) ROTARY-BODY TYPE THROTTLE VALVE FOR SPARK IGNITION INTERNAL COMBUSTION ENGINE

(75) Inventors: Osamu Suzuki, Saitama (JP); Yasushi Takahashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/820,943

(22) Filed: Mar. 30, 2001

(65) Prior Publication Data

US 2001/0035156 A1 Nov. 1, 2001

(30) Foreign Application Priority Data

Mar. 30, 2000 (JP) ..... 2000-094359

(51) Int. Cl.[7] ..... F02D 9/08
(52) U.S. Cl. ..... 123/337; 251/309; 251/315.01
(58) Field of Search ..... 123/337; 251/309, 251/315.01

(56) References Cited

U.S. PATENT DOCUMENTS

| | | | | |
|---|---|---|---|---|
| 4,271,096 A | * | 6/1981 | Kobayashi | 261/44.8 |
| 4,747,578 A | * | 5/1988 | Kivipelto et al. | 251/159 |
| 5,105,784 A | * | 4/1992 | Davis et al. | 123/190.2 |
| 5,275,373 A | | 1/1994 | Kalippke et al. | |
| 5,474,046 A | * | 12/1995 | Corona | 123/336 |
| 5,749,335 A | * | 5/1998 | Flanery et al. | 123/337 |
| 6,055,953 A | * | 5/2000 | Weickel et al. | 123/190.1 |

FOREIGN PATENT DOCUMENTS

JP 447396 11/1992

OTHER PUBLICATIONS

Abstract –European Patent Office; Osada Norisuke; Diaphragm Carburetor; Publication Number 11141402; Publication Date May 25, 1999.
Abstract –European Patent Office; Hashimoto Toshiyuki; Exhaust Brake Device; Publiation Number 10274062; Publication Date Oct. 13, 1998.

* cited by examiner

*Primary Examiner*—Erick Solis
(74) *Attorney, Agent, or Firm*—Birch, Stewart, Kolasch & Birch, LLP

(57) ABSTRACT

A rotary-body type throttle valve for a spark ignition internal combustion engine is disclosed. The valve includes a valve casing, an intake passage formed with a rotary-body recess portion, a valve element having a rotary-body shape which is rotatably fitted into the rotary-body recess portion of the valve casing, and a communication passage that permits an upstream intake passage and a downstream intake passage to communicate with each other is formed in the valve element. The upstream intake passage and the downstream intake passage sandwich the rotary-body recess portion of the valve casing. A through hole which is directed from the communication passage of the valve element in a direction intersecting a central axis of the communication passage and reaches only one of rotary outer surfaces of the valve element is formed in the valve element. This arrangement results in a reduced flow resistance by decreasing the size and number of vortices generated during partially opened states of the valve element.

10 Claims, 9 Drawing Sheets

ROTARY-BODY TYPE THROTTLE VALVE FOR SPARK IGNITION INTERNAL COMBUSTION ENGINE

BACKGROUND OF THE INVENTION

1. Field of the Invention

The present invention relates to a rotary-body type throttle valve for a spark ignition internal combustion engine, and more particularly to a rotary-body type throttle valve that can reduce flow resistance.

2. Background Art

Various rotary-body type throttle valves for spark ignition internal combustion engines, including one disclosed in Japanese Unexamined Utility Model Publication No. H4-47396, have been utilized in the conventional art.

FIG. 12 is a frontal view (as viewed in an arrow direction from a line XII—XII of FIG. 13) showing a valve fully-closed state of a conventional rotary-body type throttle valve. FIG. 13 is a cross-sectional view taken along a line XIII—XIII of FIG. 12. FIG. 14 is a cross-sectional view showing a fully-open state of a conventional throttle valve. FIG. 15 is a cross-sectional view showing a half-open state of a conventional throttle valve.

In these drawings, numeral 01 indicates a valve casing and intake passages 02*a*, 02*b* are formed in the inside of the valve casing 01. In the inside of the valve casing 01, a cylindrical recess portion 02*d* having an axis line 04 intersecting a central axis 02*c* of the intake passages 02*a*, 02*b* is formed. A columnar valve element 03 is fitted into the cylindrical recess portion such that the valve element 03 is rotatable about the axis 04.

The valve element 03 is provided with a communication passage 05 that makes the upstream intake passage 02*a* and the downstream intake passage 02*b* communicate with each other. The upstream intake passage 02*a* and the downstream intake passage 02*b* sandwich the cylindrical recess portion 02*d* of the valve casing 01.

Wall portions 06*a*, 06*b* of the valve element 03 are disposed outside the communication passage 05. The wall portions 06*a*,06*b* are accommodated in the cylindrical recess portion 02*d* of the valve casing 01 when the throttle valve is in the fully-open state shown in FIG. 14. In FIG. 12, numeral 07 indicates a flow passage at the time of idling.

Since there are no obstacles in the inside of the flow passage, the flow in the fully-open state is ideal in a rotary-body type throttle valve. Therefore flow resistance is maintained relatively low in a fully-open state.

However, when the valve is only partially opened at an intermediate degree, as shown in FIG. 15, the wall portions 06*a*, 06*b* of the valve element 03 disposed outside the communication passage 05 protrude into the interior of the flow passage. The cylindrical recess portion 02*d* that normally accommodates the wall portions 06*a*, 06*b* disposed at the outside of the communication passage 05 in the valve fully-open state is now exposed to the flow passage.

As seen in FIG. 15, vortices a, b, c, d are generated and the flow resistance is increased. The increase in flow resistance brought on by the generation of these flow vortices leads to an undesirable pressure loss.

SUMMARY OF THE INVENTION

The present invention overcomes the shortcomings associated with the related art and achieves other advantages not realized by the related art.

An aspect of the present invention is to provide a rotary body throttle valve that reduce pressure losses and reduces and/or eliminates flow vortices.

These and other aspects of the present invention are accomplished by a rotary-body type throttle valve for a spark ignition internal combustion engine comprising a valve casing having an interior; an upstream intake passage and a downstream intake passage; an intake passage formed within the interior and having a rotary-body recess portion formed within the intake passage and having an axis line intersecting a central axis of the intake passage; a valve element having a rotary-body shape rotatably fitted into the rotary-body recess portion of the valve casing; a communication passage provided between the upstream and downstream intake passages, the upstream intake passage and the downstream intake passage sandwiching the rotary-body recess portion; and a through hole formed in a first rotary outer surface of the valve element, the through hole directed from the communication passage of the valve element in a direction intersecting the central axis of the communication passage and penetrating the first rotary outer surface of the valve element.

At the time of partial opening of the valve, a portion of the normally resulting vortices is made smaller due to the flow which enters the communication passage through the through hole. Hence, the pressure loss at the time of opening of the valve to an intermediate degree can be decreased.

These and other aspects of the present invention are accomplished by a rotary-body type throttle valve for a spark ignition internal combustion engine comprising a valve casing having an interior; an upstream intake passage and a downstream intake passage; an intake passage formed within the interior and having a rotary-body recess portion formed within the intake passage and having an axis line intersecting a central axis of the intake passage; a valve element having a rotary-body shape rotatably fitted into the rotary-body recess portion of the valve casing; a communication passage provided between the upstream and downstream intake passages, the upstream intake passage and the downstream intake passage sandwiching the rotary-body recess portion; and a groove formed in at least a portion of an inclined wall surface of the upstream intake passage and in parallel with a planar plane including an axis of the upstream intake passage and a rotary axis of the valve element.

At the time of partial opening of the, it becomes possible to make the normally resulting vortices in the flowstream which enter the communication passage even smaller. Therefore, the flow resistance at the time of opening of the valve to an intermediate degree can be further decreased.

These and other aspects of the present invention are accomplished by a A rotary-body type throttle valve for a spark ignition internal combustion engine comprising a valve casing having an interior; an upstream intake passage and a downstream intake passage, wherein the upstream intake passage is formed having a funnel shape, the funnel shape having a cross-sectional area that reduces in cross-sectional area as the upstream intake passage approaches the communication passage; an intake passage formed within the interior and having a rotary-body recess portion formed within the intake passage and having an axis line intersecting a central axis of the intake passage; a valve element having a rotary-body shape rotatably fitted into the rotary-body recess portion of the valve casing; a communication passage provided between the upstream and downstream intake passages, the upstream intake passage and the downstream intake passage sandwiching the rotary-body recess portion; and a through hole formed in a first rotary outer surface of the valve element, the through hole directed from the communication passage of the valve element in a direction intersecting the central axis of the communication passage and penetrating the first rotary outer surface of the valve element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not intended to limit the present invention to the embodiments shown, and wherein.

DETAILED DESCRIPTION OF THE PREFERRED EMBODIMENTS

Hereinafter, the present invention will be described in detail with reference to the accompanying drawings. Preferred embodiments of the invention are explained in conjunction with drawings hereinafter.

Figure 1:
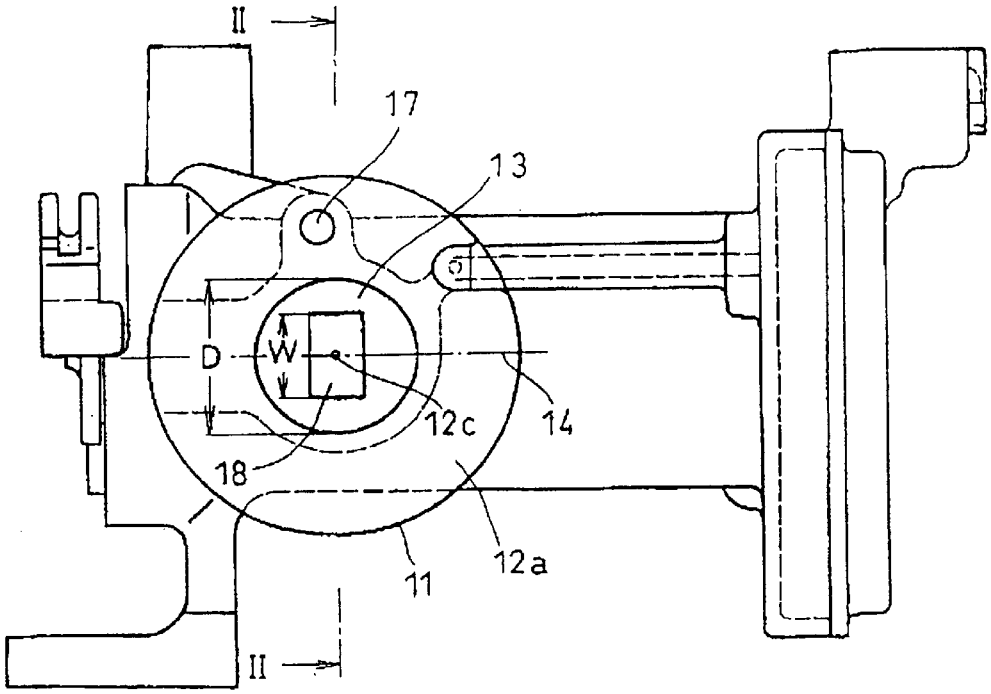
FIG. 1 is a frontal view of a rotary body throttle valve according to an embodiment of the present invention.
Figure 2:
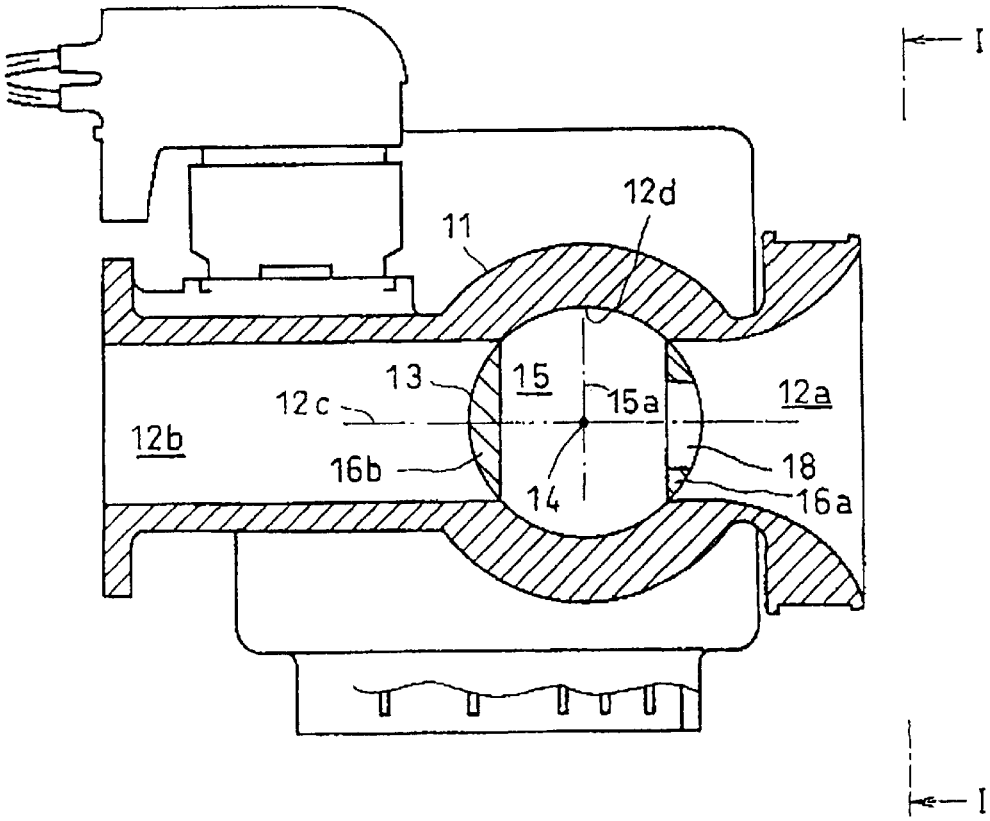
FIG. 2 is a cross-sectional view according to an embodiment of the present invention taken along a line II—II of FIG. 1.
Figure 3:
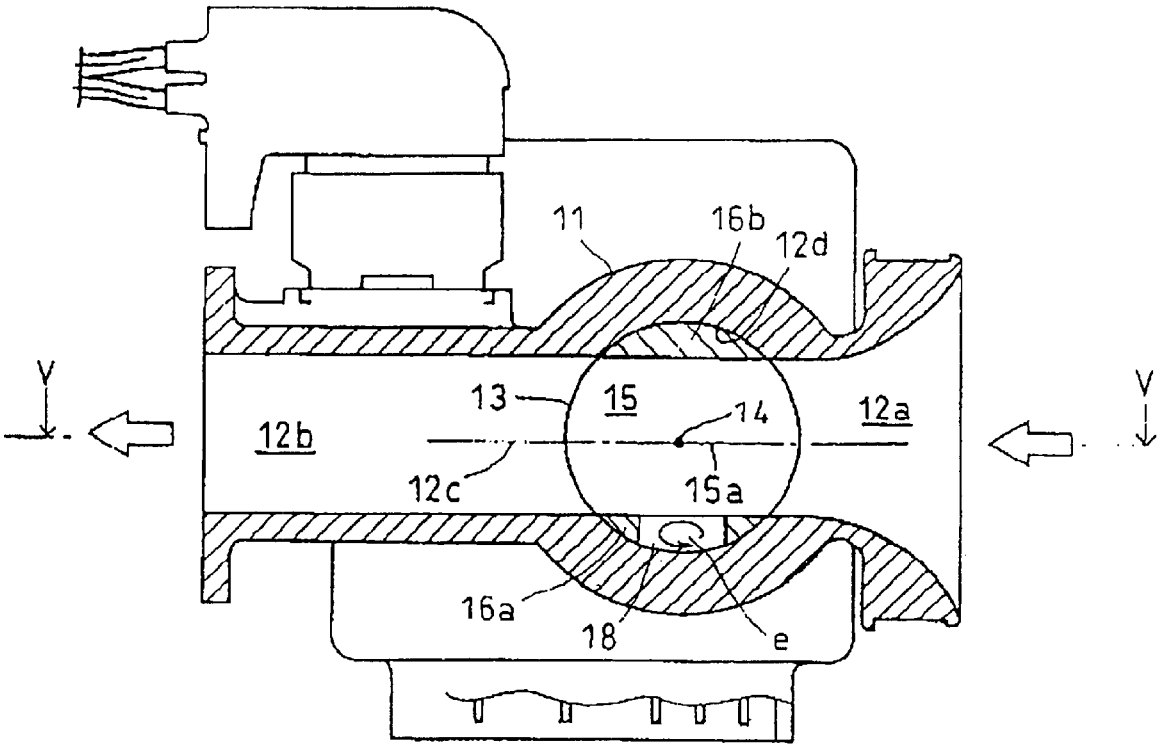
FIG. 3 is a cross-sectional view showing a fully-open state of a throttle valve according to an embodiment of the present invention.
Figure 4:
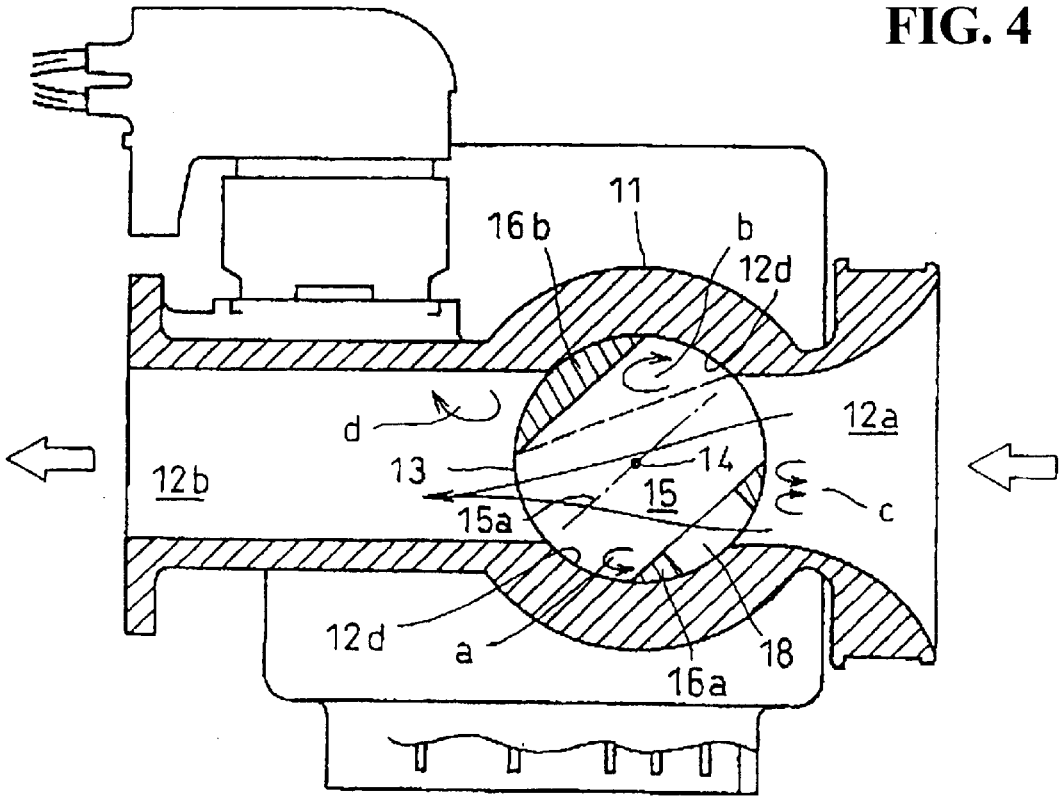
FIG. 4 is a cross-sectional view showing a half-open state of a throttle valve according to an embodiment of the present invention.

FIG. 1 is a frontal view of a rotary body throttle valve according to an embodiment of the present invention. FIG. 2 is a cross-sectional view according to an embodiment of the present invention taken along a line II—II of FIG. 1. FIG. 3 is a cross-sectional view showing a fully-open state of a throttle valve according to an embodiment of the present invention. FIG. 4 is a cross-sectional view showing a half-open state of a throttle valve according to an embodiment of the present invention.

Figure 5:
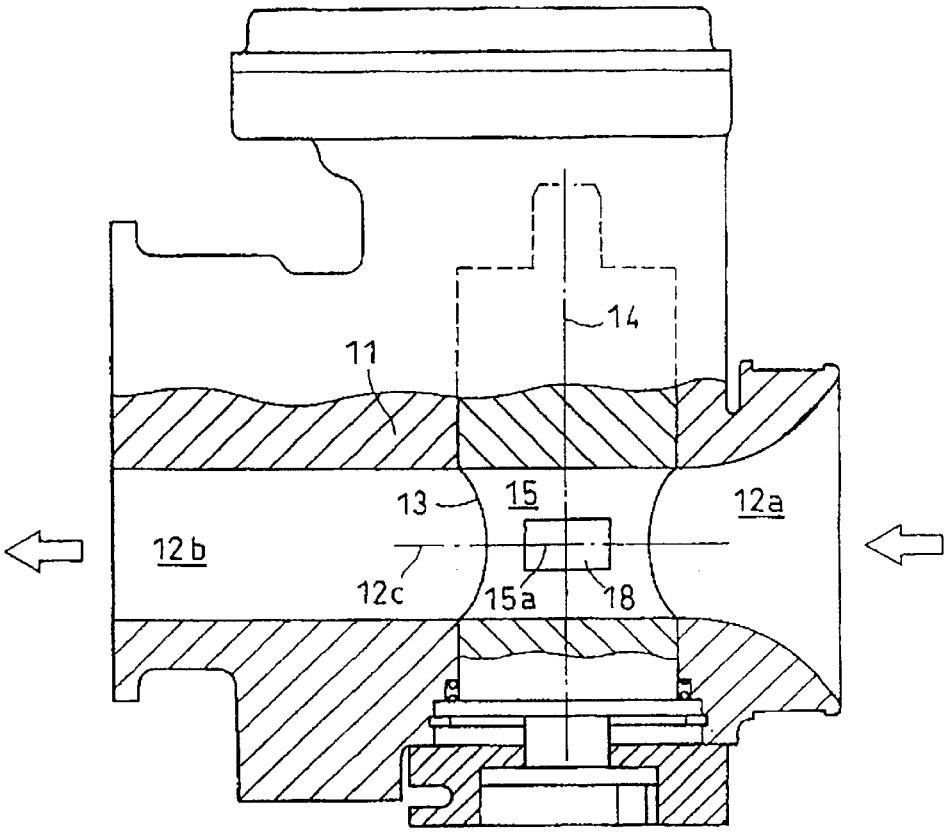
FIG. 5 is a cross-sectional view taken along a line V—V of FIG. 3 according to an embodiment of the present invention.

FIG. 5 is a cross-sectional view taken along a line V—V of FIG. 3 according to an embodiment of the present invention.

In these drawings, intake passages 12*a*, 12*b* are formed in an interior of a valve casing 11. In the interior of the valve casing 11, a cylindrical recess portion 12*d* which has an axis line 14 intersecting a central axis 12*c* of the intake passages 12*a*, 12*b* is formed.

A columnar valve element 13 is fitted into the cylindrical recess portion such that the valve element 13 is rotatable about the axis 14. The valve element 13 is provided with a communication passage 15 that permits the upstream intake passage 12*a* and the downstream intake passage 12*b* communicate with each other. The upstream intake passage 12*a* and the downstream intake passage sandwich the cylindrical recess portion 12*d* of the valve casing 11.

Wall portions 16*a*, 16*b* of the valve element 13 disposed outside of the communication passage 15 are accommodated in the cylindrical recess portion 12*d* of the valve casing 11 when the throttle valve is in the valve fully-open state shown in FIG. 3. In FIG. 1, a flow passage at the time of idling is indicated generally by numeral 17.

A through hole 18 is formed in the valve element 13 such that the through hole 18 is directed from the communication passage 15 of the valve element 13 in a direction which intersects a central axis 15*a* of the communication passage. The through hole 18 passes through one valve wall 16*a* of the two opposing valve walls 16*a*, 16*b*, and reaches a rotary outer surface of the valve element 13.

When the valve is only partially opened as shown in FIG. 4, vortices a, c are reduced due to a flow which enters the communication passage 15 through the through hole 18. Accordingly, the pressure loss when the valve is partially opened can also be reduced. Further, as shown in FIG. 2, the flow still remains shut off by the other valve wall 16*b* in the valve's fully-closed state.

In the valve's fully-open state, as shown in FIG. 3, although the vortex e is generated in the inside of the through hole 18, this vortex is relatively small. Accordingly, the pressure loss is extremely small.

It is preferable that a dimension W of the through hole 18 in the circumferential direction of the valve element 13 is set to a predetermined value. The predetermined value of W is set to be not less than ⅓ of a diameter D of the intake passages 12*a*, 12*b* and not more than ⅔ of the diameter D of the intake passages 12*a*, 12*b*. When the dimension W exceeds ⅔ of the diameter D, the vortex e in the valve's fully-open state shown in FIG. 3 increases significantly. Accordingly, the flow resistance is increased.

When the dimension W is less than ⅓, the vortices a, b, c at the time of partially opening of the valve as shown in FIG. 4 become larger. Accordingly, the pressure loss is further increased.

Figure 6:
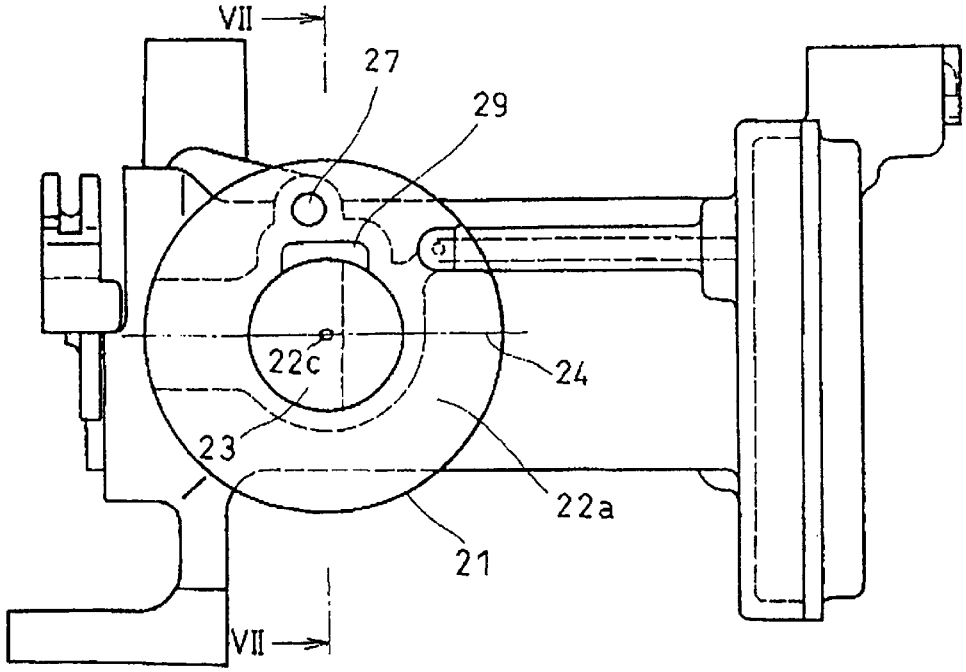
FIG. 6 is a frontal view of a valve in a fully-closed state according to an embodiment of the present invention.

FIG. 6 is a frontal view of a valve in a fully-closed state according to an embodiment of the present invention. FIG.

Figure 8:
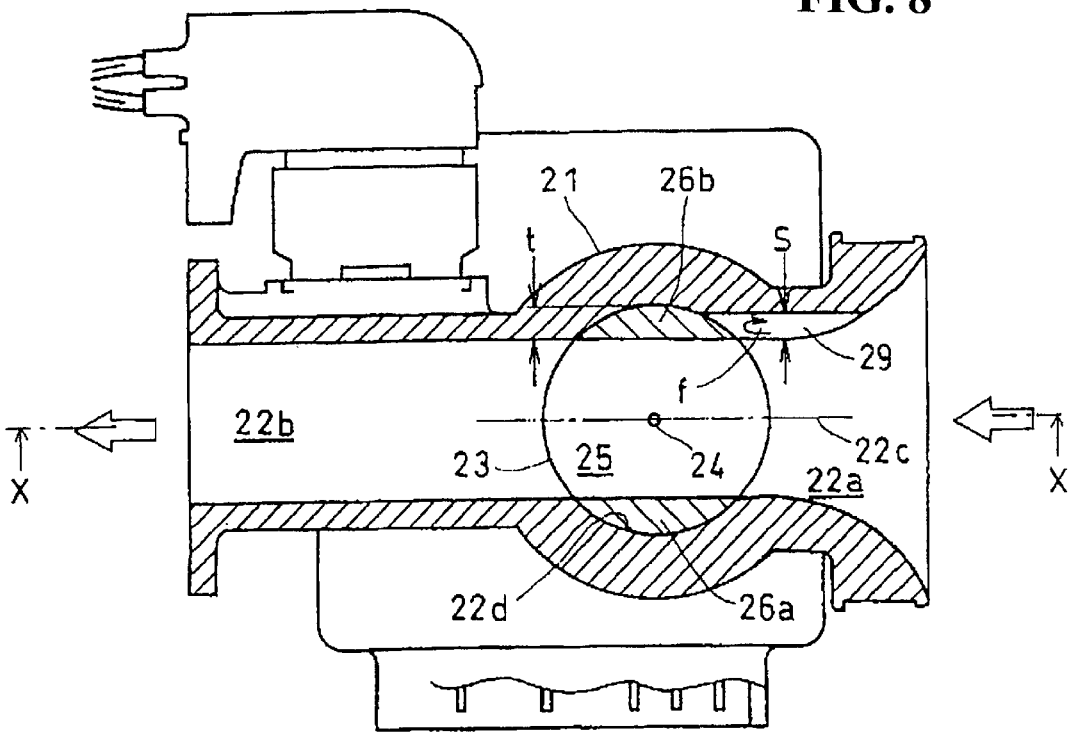
FIG. 8 is a cross-sectional view showing a fully-open state of a throttle valve according to an embodiment of the present invention.
Figure 9:
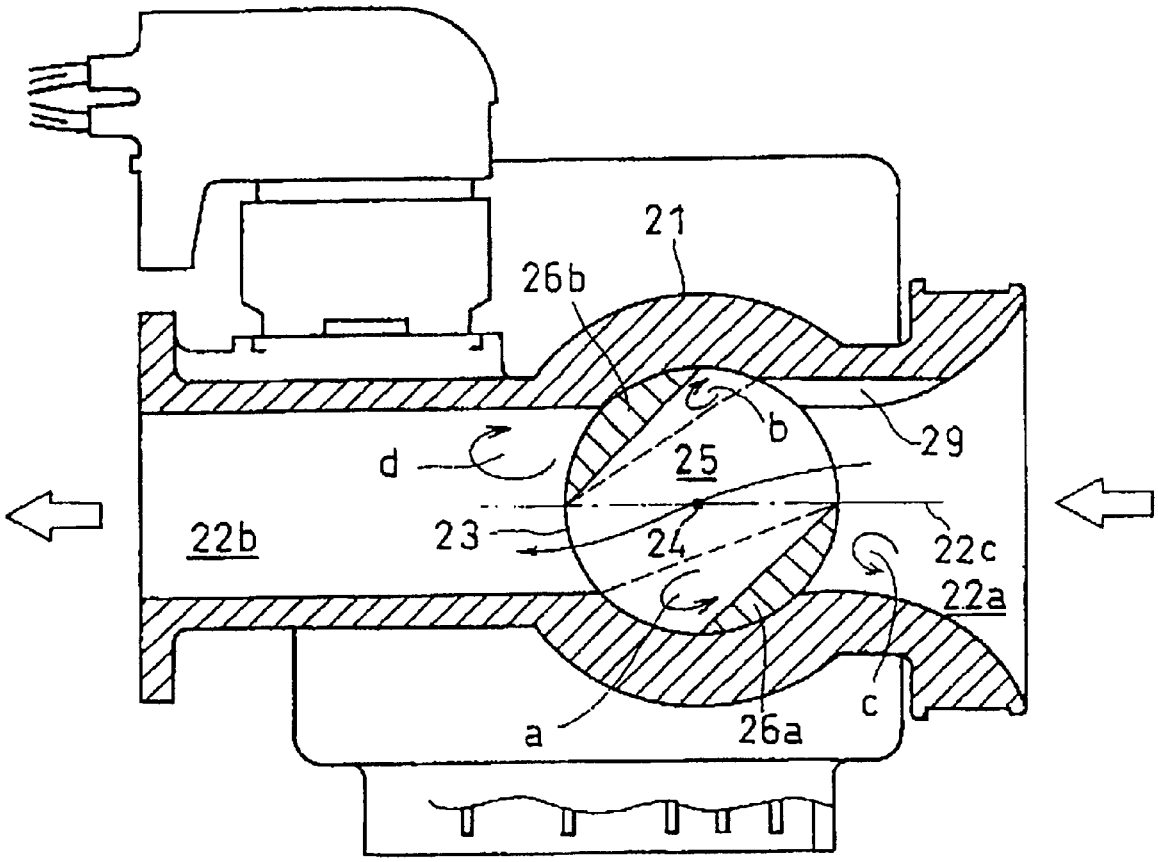
FIG. 9 is a cross-sectional view showing a half-open state of a throttle valve according to an embodiment of the present invention.
Figure 10:
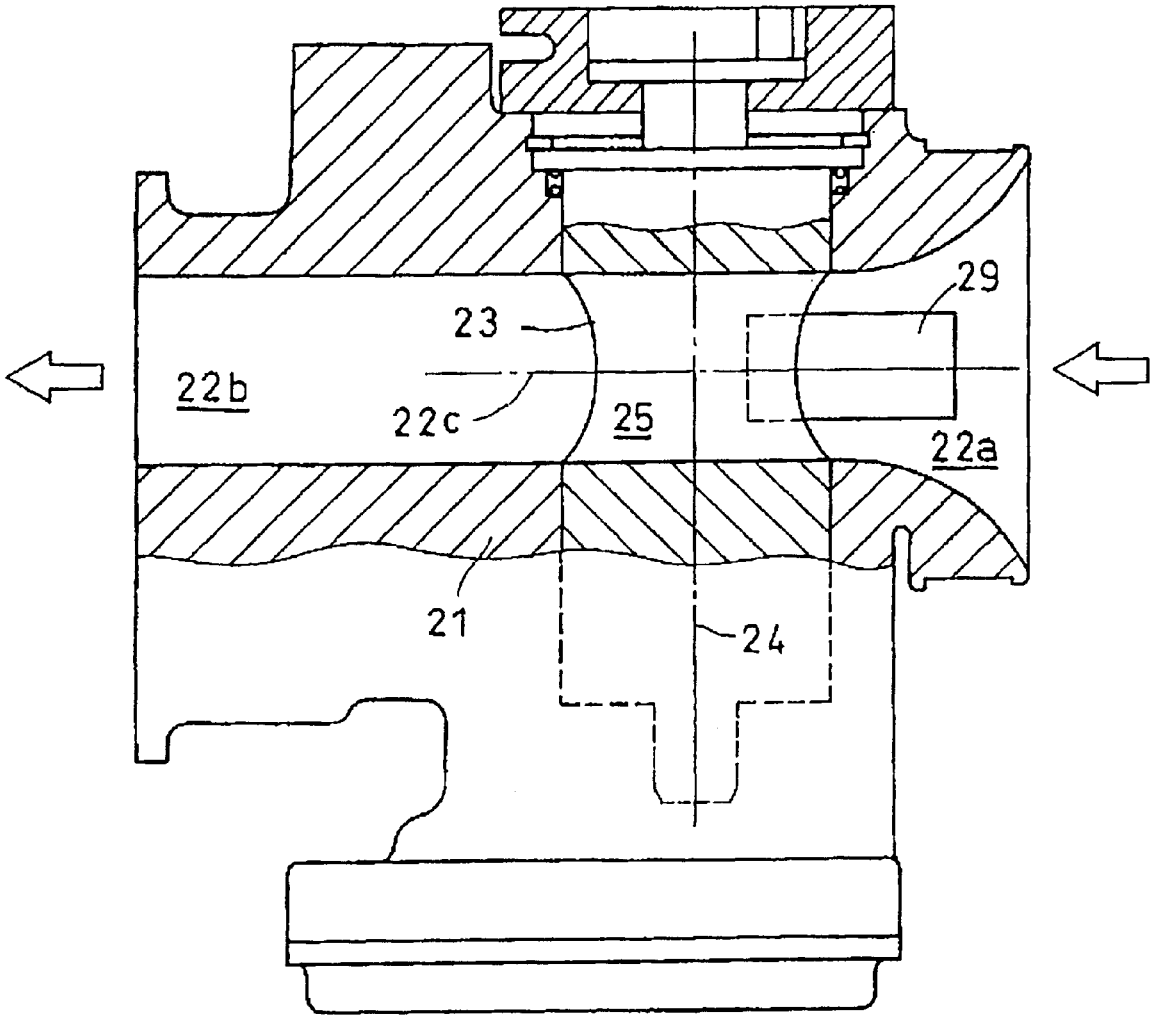
FIG. 10 is a cross-sectional view taken along a line X—X of FIG. 8 according to an embodiment of the present invention.

7 is a cross-sectional view taken along a line VII—VII of FIG. 6. FIG. 8 is a cross-sectional view showing a fully-open state of a throttle valve according to an embodiment of the present invention. FIG. 9 is a cross-sectional view showing a half-open state of a throttle valve according to an embodiment of the present invention. FIG. 10 is a cross-sectional view taken along a line X—X of FIG. 8 according to an embodiment of the present invention.

In these drawings, intake passages 22*a*, 22*b* are formed in an interior of a valve casing 21. In the interior of the valve casing 21, a cylindrical recess portion 22*d* having an axis line 24 intersecting a central axis 22*c* of the intake passages 22*a*22*b* is formed. A columnar valve element 23 is fitted into the cylindrical recess portion such that the valve element 23 is rotatable about the axis 24.

The valve element 23 is provided with a communication passage 25 that permits the upstream intake passage 22*a* and the downstream intake passage 22*b* to communicate with each other. The upstream intake passage 22*a* and the downstream intake passage 22*b* sandwich the cylindrical recess portion 22*d* of the valve casing 21.

Figure 7:
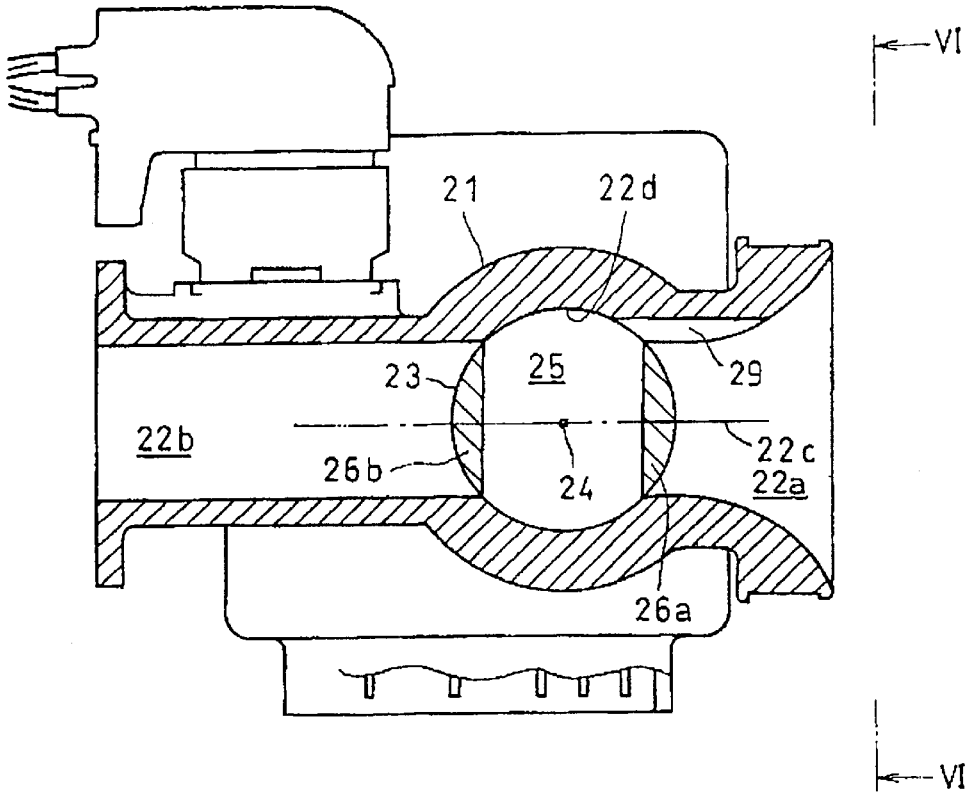
FIG. 7 is a cross-sectional view taken along a line VII—VII of FIG. 6.

Wall portions 26*a*, 26*b* of the valve element 23 disposed outside of the communication passage 25 are accommodated in the cylindrical recess portion 22*d* of the valve casing 21 when the throttle valve is in the fully-open state shown in FIG. 7. In FIG. 6, a flow passage at the time of idling is indicated by numeral 27.

However, in this embodiment, as shown in FIG. 7, the upstream intake passage 22*a* has a cross-sectional area thereof reduced toward the downstream in a funnel shape. A groove 29 which is parallel to a planar plane including the central axis 22*c* of the upstream intake passage and the rotary axis 24 of the valve is formed in a potion of the inclined wall surface. A depth s of this groove 29 is designed so as not to exceed a thickness t of a valve wall 26*b* of the valve element 23.

At the time of partial opening of the valve as shown in FIG. 9, the vortex b in the flowstream that enters the communication passage 25 is reduced. Therefore, the flow resistance at the time of opening of the valve with an intermediate degree of opening is also reduced.

Although a vortex f is generated at the downstream end of the groove 29 during a fully-open state of the valve as shown in FIG. 8, this vortex is relatively small. Hence, the pressure loss is extremely small.

Further, since the depth s of the groove 29 does not exceed the thickness t of the valve wall 26*b*, the flow passage still remains completely shut off as shown in FIG. 7 in the valve's fully-closed state.

Figure 11:
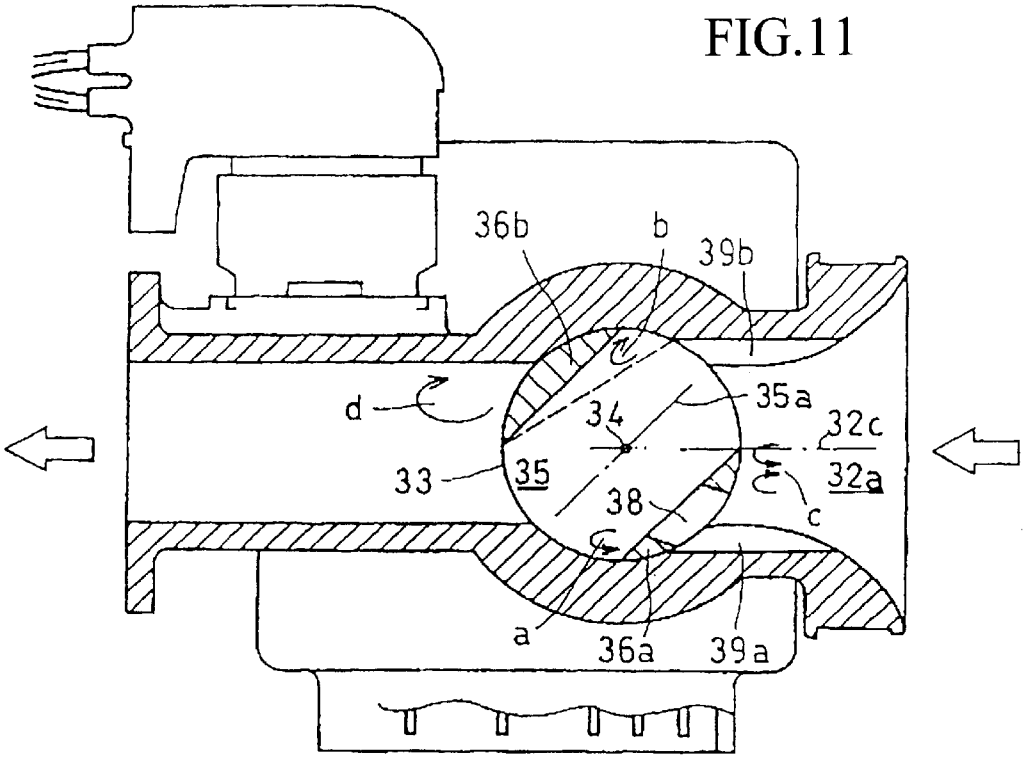
FIG. 11 is a cross-sectional view showing an intermediate degree of opening according to an embodiment of the present invention.
Figure 12:
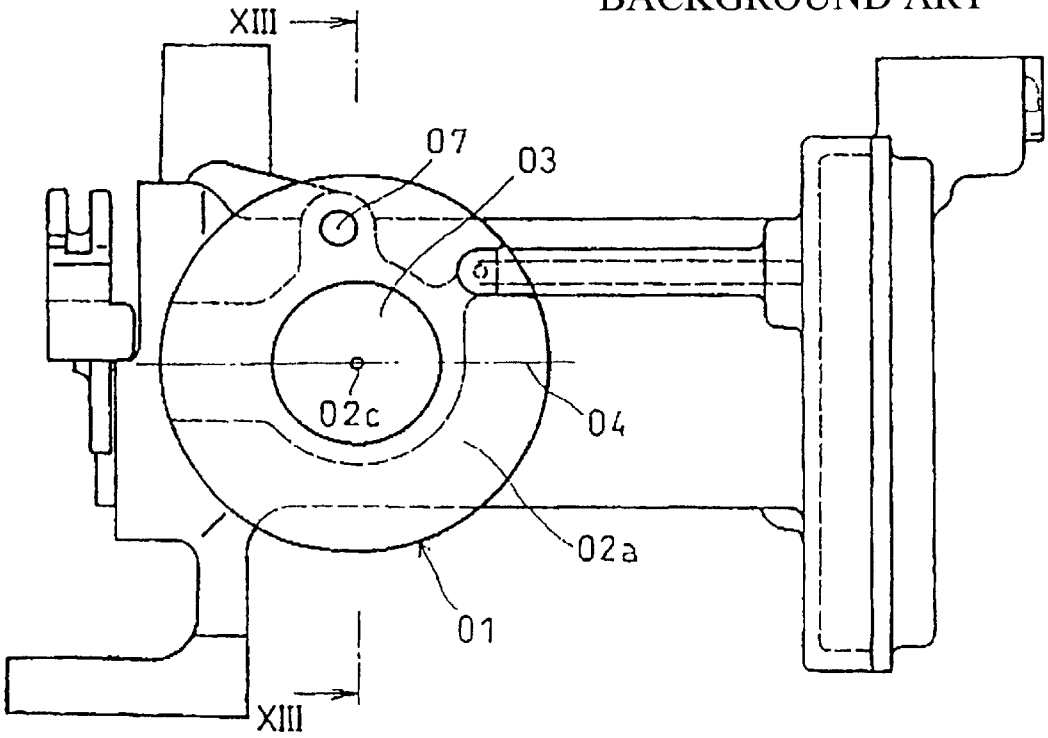
FIG.12 BACKGROUND ART
FIG. 12 is a frontal view showing a valve fully-closed state of a conventional rotary-body type throttle valve.
Figure 13:
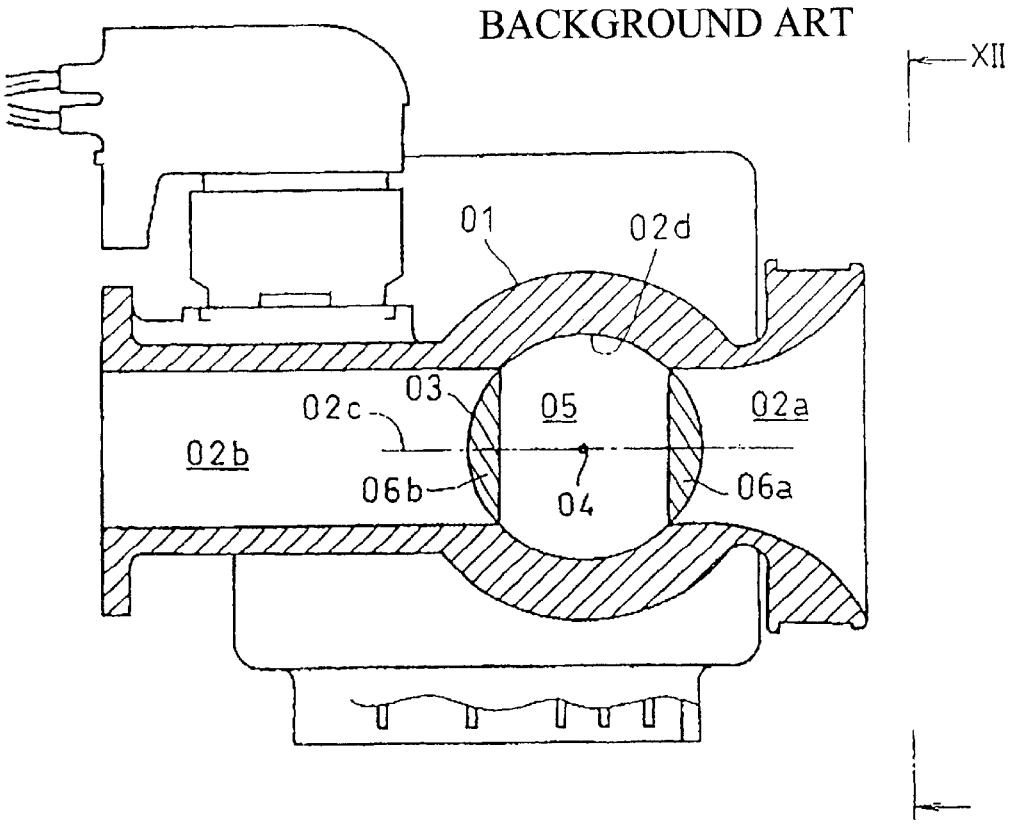
FIG.13 BACKGROUND ART
FIG. 13 is a cross-sectional view taken along a line XIII—XIII of FIG. 12.
Figure 14:
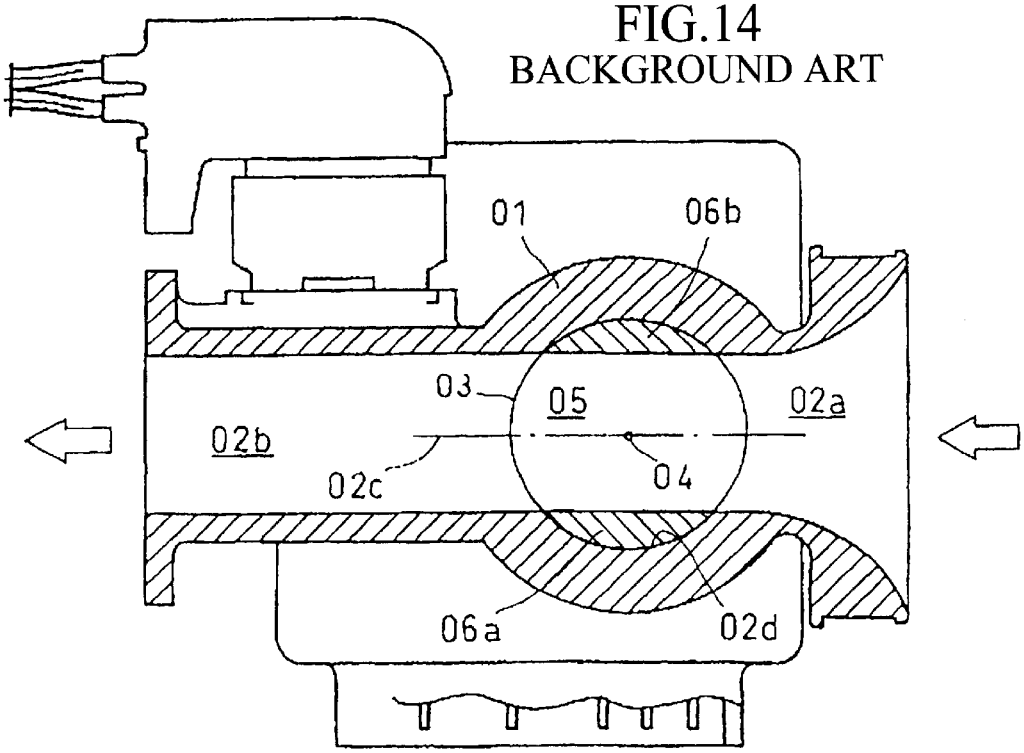
FIG.14 BACKGROUND ART
FIG. 14 is a cross-sectional view showing a fully-open state of a conventional throttle valve.
Figure 15:
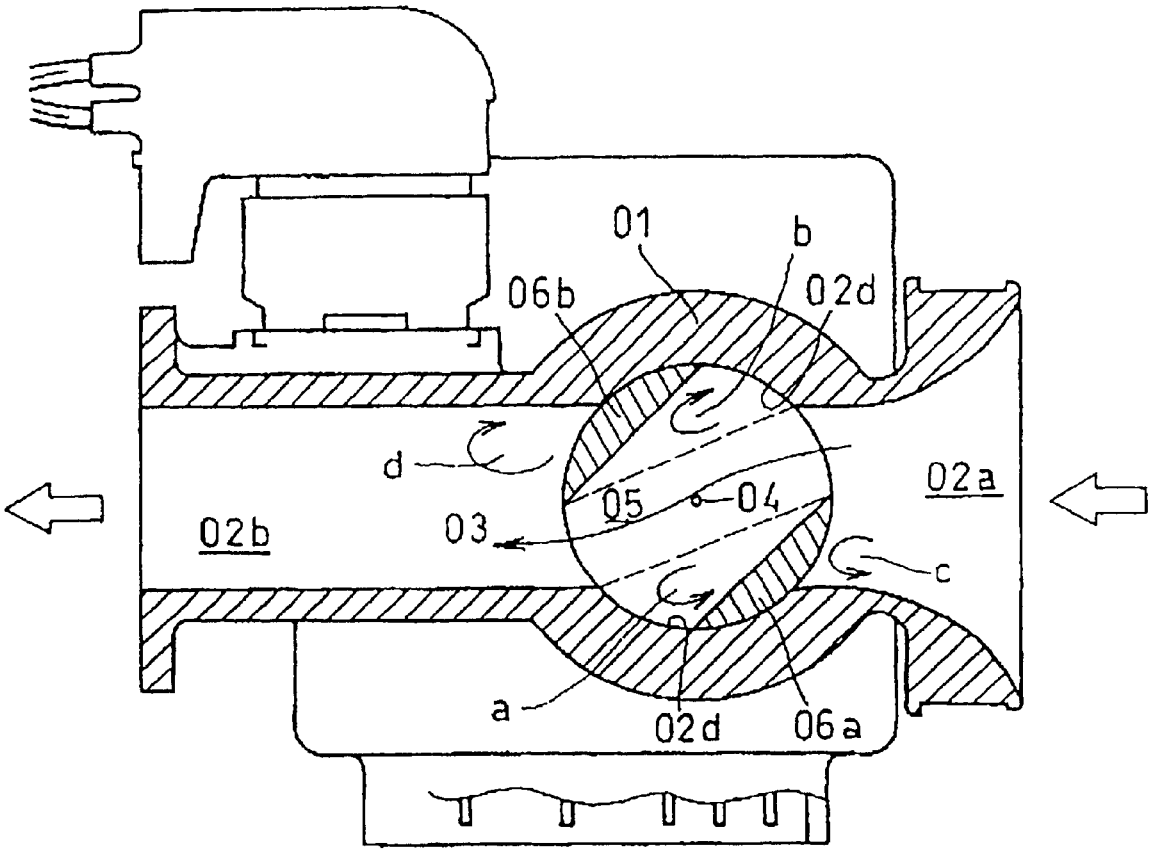
FIG.15 BACKGROUND ART
FIG. 15 is a cross-sectional view showing a half-open state of a conventional throttle valve.

FIG. 11 is a cross-sectional view showing an intermediate degree of opening according to an embodiment of the present invention. In this embodiment, a through hole 38 is formed in the valve element 33 such that the through hole 38 is directed from a communication passage 35 of a valve element 33 in the direction that intersects a central axis 35*a* of the communication passage 35.

The through hole 38 passes through one valve wall 36*a* of two opposing valve walls 36*a*, 36*b* and reaches a rotary outer surface of the valve element 33. Further, in a similar manner as the second embodiment, grooves 39*a*, 39*b* are provided which are parallel to a planar plane including a central axis 32*c* of an upsteam intake passage and a rotary axis 34 of the valve.

The grooves 39*a*, 39*b* have a depth which does not exceed a thickness of the valve walls 36*a*, 36*b* of the valve element 33. As seen in FIG. 11, the grooves 39*a*,39*b* are formed in two portions of the inclined wall surface formed at a funnel-like inlet passage 32*a*.

In this embodiment, all resulting vortices a, b, c are reduced in the valve's partially open state. Accordingly, the overall flow resistance is also reduced.

In the respective modes for carrying out the present invention, a case in which the cylindrical recess portion is formed in the valve casing and the columnar valve element is fitted into the recess portion has been explained. However, the shapes of these recess portions and valve elements are not specifically limited to the cylinder and the column shapes described in the foregoing embodiments. It shall be appreciated that various rotary-body shapes such as a spherical shape, a barrel shape, a conical shape, etc. may be applicable to the invention as necessary.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotary-body type throttle valve for a spark ignition internal combustion engine comprising:

a valve casing having an interior;

an upstream intake passage and a downstream intake passage;

an intake passage formed within said interior and having a rotary-body recess portion formed within said intake passage and having an axis line intersecting a central axis of said intake passage;

a valve element having a rotary-body shape rotatably fitted into said rotary-body recess portion of said valve casing;

a communication passage provided between said upstream and downstream intake passages, said upstream intake passage and said downstream intake passage sandwiching said rotary-body recess portion; and a through hole formed in a first rotary outer surface of said valve element, said through hole directed from said communication passage of said valve element in a direction intersecting the central axis of said communication passage and penetrating said first rotary outer surface of said valve element, wherein a dimension of said through hole as measured with respect to a circumferential direction of said valve-element is set between ⅓ to ⅔ of a diameter of said intake passage.

2. The valve according to claim 1, wherein said valve element includes a first wall portion and a second wall portion disposed in radially opposite positions, respectively, and located along an exterior of said communication passage in a fully-open valve state.

3. The valve according to claim 2, wherein said upstream intake passage is formed having a funnel shape, said funnel shape having a cross-sectional area that reduces in cross-sectional area as said upstream intake passage approaches said communication passage.

4. The valve according to claim 3, wherein said valve element includes a first wall portion and a second wall portion disposed in radially opposite positions, respectively, and located along an exterior of said communication passage in a fully-open valve state.

5. A rotary-body type throttle valve for a spark ignition internal combustion engine comprising:

a valve casing having an interior;

an upstream intake passage and a downstream intake passage;

an intake passage formed within said interior and having a rotary-body recess portion formed within said intake passage and having an axis line intersecting a central axis of said intake passage;

a valve element having a rotary-body shape rotatably fitted into said rotary-body recess portion of said valve casing;

a communication passage provided between said upstream and downstream intake passages, said upstream intake passage and said downstream intake passage sandwiching said rotary-body recess portion; and a groove formed in at least a portion of an inclined wall surface of said upstream intake passage and in parallel with a planar plane including an axis of said upstream intake passage and a rotary axis of said valve element.

6. The valve according to claim 5, wherein said groove has a depth less than or equal to a thickness of a valve wall of said valve element.

7. A rotary-body type throttle valve for a spark ignition internal combustion engine comprising:

a valve casing having an interior;

an upstream intake passage and a downstream intake passage, wherein said upstream intake passage is formed having a funnel shape, said funnel shape having a cross-sectional area that reduces in cross-sectional area as said upstream intake passage approaches said communication passage;

an intake passage formed within said interior and having a rotary-body recess portion formed within said intake passage and having an axis line intersecting a central axis of said intake passage;

a valve element having a rotary-body shape rotatably fitted into said rotary-body recess portion of said valve casing;

a communication passage provided between said upstream and downstream intake passages, said upstream intake passage and said downstream intake passage sandwiching said rotary-body recess portion;

a through hole formed in a first rotary outer surface of said valve element, said through hole directed from said communication passage of said valve element in a direction intersecting the central axis of said communication passage and penetrating said first rotary outer surface of said valve element; and at least one groove formed in at least a portion of an inclined wall surface of said upstream intake passage and in parallel with a planar plane including an axis of said upstream intake passage and a rotary axis of said valve element.

8. The valve according to claim 7, wherein said groove has a depth less than or equal to a thickness of a valve wall of said valve element.

9. The valve according to claim 8, wherein a dimension of said through hole as measured with respect to a circumferential direction of said valve-element is set between ⅓ to ⅔ of a diameter of said intake passage.

10. A rotary-body type throttle valve for a spark ignition internal combustion engine comprising:

a valve casing having an interior;

an upstream intake passage and a downstream intake passage, wherein said upstream intake passage is formed having a funnel shape, said funnel shape having a cross-sectional area that reduces in cross-sectional area as said upstream intake passage approaches said communication passage;

an intake passage formed within said interior and having a rotary-body recess portion formed within said intake passage and having an axis line intersecting a central axis of said intake passage;

a valve element having a rotary-body shape rotatably fitted into said rotary-body recess portion of said valve casing;

a communication passage provided between said upstream and downstream intake passages, said upstream intake passage and said downstream intake passage sandwiching said rotary-body recess portion;

a through hole formed in a first rotary outer surface of said valve element, said through hole directed from said communication passage of said valve element in a direction intersecting the central axis of said communication passage and penetrating said first rotary outer surface of said valve element, wherein a dimension of said through hole as measured with respect to a circumferential direction of said valve-element is set between ⅓ to ⅔ of a diameter of said intake passage.

* * * * *